US012257491B2

(12) United States Patent
Goldenring et al.

(10) Patent No.: US 12,257,491 B2
(45) Date of Patent: Mar. 25, 2025

(54) METHOD AND APPARATUS FOR REDUCING BODY STRESS TYPICALLY EXPERIENCED BY A SNOWBOARDER WHILE ON A CHAIRLIFT

(71) Applicant: RINCON VENTURES LLC, Ventura, CA (US)

(72) Inventors: Ira Goldenring, Ventura, CA (US); Alex Goldenring, Ventura, CA (US); Jonathan Palafox, Tucson, AZ (US)

( * ) Notice: Subject to any disclaimer, the term of this patent is extended or adjusted under 35 U.S.C. 154(b) by 0 days.

(21) Appl. No.: 17/788,212

(22) PCT Filed: Dec. 11, 2020

(86) PCT No.: PCT/US2020/064599

§ 371 (c)(1),
(2) Date: Jun. 22, 2022

(87) PCT Pub. No.: WO2021/133571

PCT Pub. Date: Jul. 1, 2021

(65) Prior Publication Data

US 2023/0022873 A1 Jan. 26, 2023

Related U.S. Application Data

(60) Provisional application No. 62/953,561, filed on Dec. 25, 2019.

(51) Int. Cl.

| | |
|---|---|
| ***A63C 10/20*** | (2012.01) |
| ***A63C 10/14*** | (2012.01) |
| ***A63C 10/28*** | (2012.01) |

(52) U.S. Cl.

CPC ..... *A63C 10/20* (2013.01); *A63C 10/14* (2013.01); *A63C 10/28* (2013.01); *A63C 2203/54* (2013.01)

(58) Field of Classification Search

CPC ..... A63C 10/20; A63C 10/14; A63C 10/28; A63C 2203/54; A63C 10/18; A43B 5/0403

See application file for complete search history.

(56) References Cited

U.S. PATENT DOCUMENTS 5,505,478 A * 4/1996 Napoliello ..... A63C 10/14 280/14.22
5,713,594 A * 2/1998 Jenni ..... A63C 10/103 280/624

(Continued)

FOREIGN PATENT DOCUMENTS

DE 19608025 A1 * 9/1997 ..... A63C 10/04
WO WO-9617660 A1 * 6/1996 ..... A63C 10/10

(Continued)

*Primary Examiner* — James A Shriver, II
*Assistant Examiner* — Michael T. Walsh

(57) ABSTRACT

A Method and apparatus for reducing stress on the body (e.g., foot, ankle, hip, spine) of a snowboarder while sitting on a chairlift. The apparatus includes a boot binding assembly adapted for mounting on the top surface of a snowboard including a boot retention member hinged for movement between a closed position and an open position. For typical downhill snowboarding activity, a user will place the retention member in the closed position to orient the sole of the user's boot substantially parallel, i.e. against the snowboard top surface. For sitting on a chairlift, the user will place the retention member in the open position so as to allow the snowboard to pivot around the hinge and hang substantially vertically from the retention member thus avoiding stressful torques on the user's supporting limb.

16 Claims, 7 Drawing Sheets

(56) References Cited

U.S. PATENT DOCUMENTS

| | | | | | |
|---|---|---|---|---|---|
| 5,813,689 | A * | 9/1998 | Mansure | A63C 10/04 | 280/14.22 |
| 5,855,390 | A * | 1/1999 | Hassell | A63C 10/28 | 280/607 |
| 6,460,871 | B1 * | 10/2002 | Dodge | A63C 10/103 | 280/14.22 |
| 7,575,252 | B2 * | 8/2009 | Smith | A63C 11/10 | 280/809 |
| 8,322,730 | B2 * | 12/2012 | Sorenson | A63C 10/28 | 280/14.22 |
| 9,004,503 | B2 * | 4/2015 | Sorenson | A63C 10/16 | 280/14.22 |
| 10,272,318 | B2 * | 4/2019 | Rupp | A63C 7/02 | |
| 10,864,429 | B2 * | 12/2020 | Dreifus | A63C 10/005 | |
| 2014/0210187 | A1 * | 7/2014 | Ritter | A63C 9/02 | 280/611 |
| 2015/0246278 | A1 * | 9/2015 | Ritter | A63C 9/20 | 280/626 |
| 2020/0391097 | A1 * | 12/2020 | Grady | A63C 10/18 | |

FOREIGN PATENT DOCUMENTS

| | | | | |
|---|---|---|---|---|
| WO | WO-02064222 | A2 * | 8/2002 | A63C 10/10 |
| WO | WO2011044067 | | 4/2011 | |

* cited by examiner

METHOD AND APPARATUS FOR REDUCING BODY STRESS TYPICALLY EXPERIENCED BY A SNOWBOARDER WHILE ON A CHAIRLIFT

RELATED APPLICATION

This application claims priority based on U.S. Provisional Application No. 62/953,561 filed on 25 Dec. 2019 which is by reference incorporated herein.

BACKGROUND OF THE INVENTION

Snowboard bindings function to attach a user's boots to the snowboard top surface with the boots oriented generally across the board's width, i.e., from toe edge to heel edge. Typically a board carries two bindings for respectively accommodating the user's left boot and right boot. The binding closest to the nose of the board is generally referred to as the front or lead binding and the binding closer to the tail of the board is generally referred to as the rear or hind binding. The bindings function to transfer a user's body movements to the board for enabling the user to control the board's traverse along a snow slope.

Prior to boarding a chairlift, a typical snowboarder releases his rear binding to free his rear foot to facilitate his movement along the flat ground and through lift lines to reach the chair boarding area. He then mounts the chair and rides it upslope with the snowboard suspended from the front binding typically oriented at an approximate 30-45 degree angle relative to the horizontal plane (i.e., perpendicular to gravity). The weight of the board supported at such an angle induces an external torque on the user's supporting limb potentially causing discomfort and, over time, stress injury.

SUMMARY OF THE INVENTION

The present invention is directed to a method and apparatus for alleviating the discomfort and body stress experienced by a snowboard user when sitting on a chairlift. More particularly, the invention is directed to a method and apparatus for mitigating the stressful torques historically experienced by a user attributable to the weight and orientation of the board acting on the user's supporting limb. The reduction of such torques in accordance with the invention is achieved by a binding apparatus and method of use which orients the board during the chairlift ride so that it hangs substantially vertically from the user's supporting limb.

A preferred embodiment of the invention comprises a binding assembly including a boot retention member hinged to a mounting plate configured for attachment to the top surface of a snowboard. The retention member is hinged to the mounting plate so as to allow the retention member to pivot between an open position orienting a user's boot sole substantially perpendicular to the board top surface and a closed position orienting the sole substantially parallel and adjacent to said board top surface. A latch mechanism enables the retention member to be locked in the closed position for use during normal snowboarding activity. An actuator, e.g., a lever accessible to the user, enables the user to readily release the latch mechanism when on the chairlift to allow the board to pivot around the hinge to the open position. In the open position, the board will hang substantially vertically from the hinge. This orientation mitigates stressful torques on the user's supporting limb. When exiting at the upper end of the chairlift ride, the user can manually relatch the retention member or apply his body weight to the retention member to cause the latch mechanism to automatically latch the retention member in the closed position.

DESCRIPTION OF PREFERRED EMBODIMENT

Figure 1:
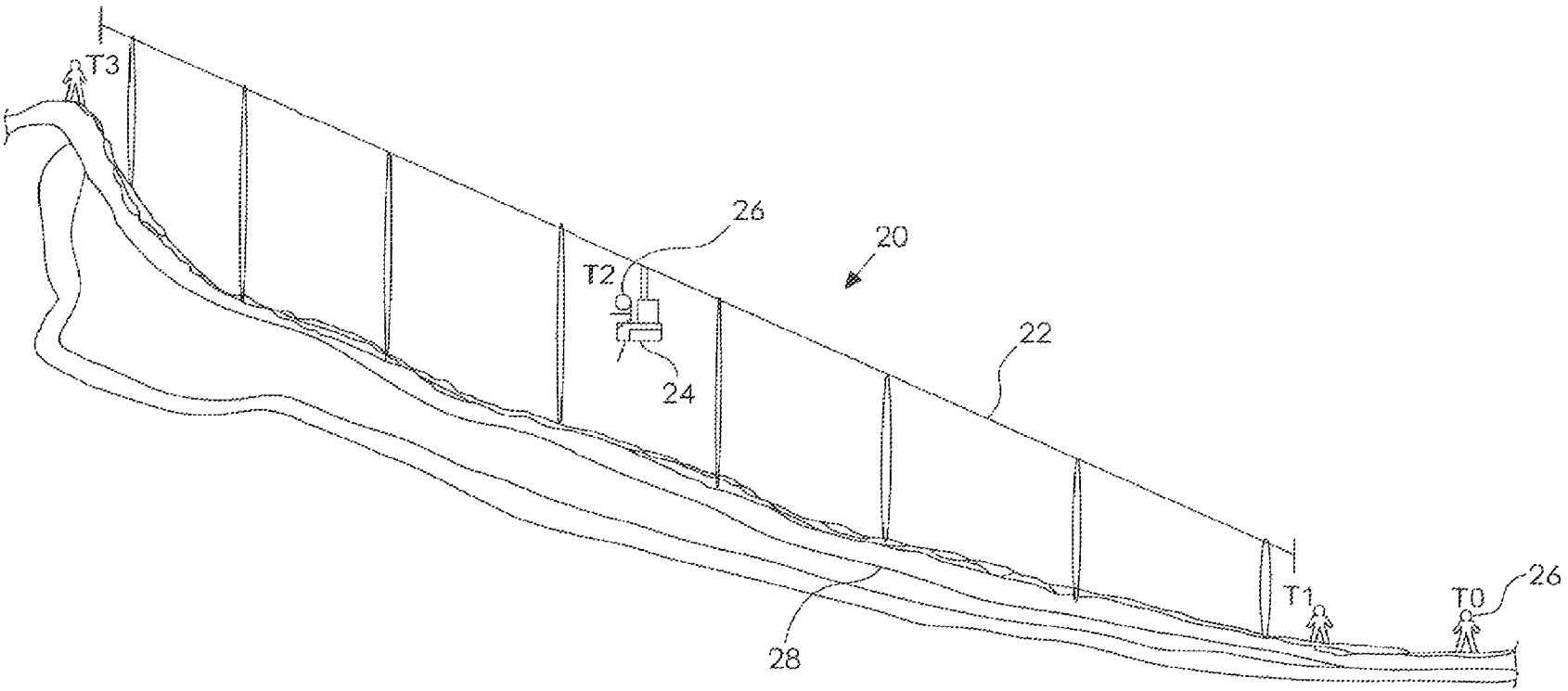
FIG. 1 is a schematic timeline depicting the use of an embodiment of the invention.

Attention is initially directed to FIG. 1 which schematically depicts a typical snowboard chairlift system 20 comprised of a tow cable 22 and at least one lift chair 24 attached to the cable for transporting a snowboard user 26 up the snow slope 28. FIG. 1 represents the user 26 at time T0 just prior to mounting the chair 24. The interval T1-T2 represents the time the user is being transported up the slope and T3 is the time just prior to the user exiting the chairlift.

Figure 3:
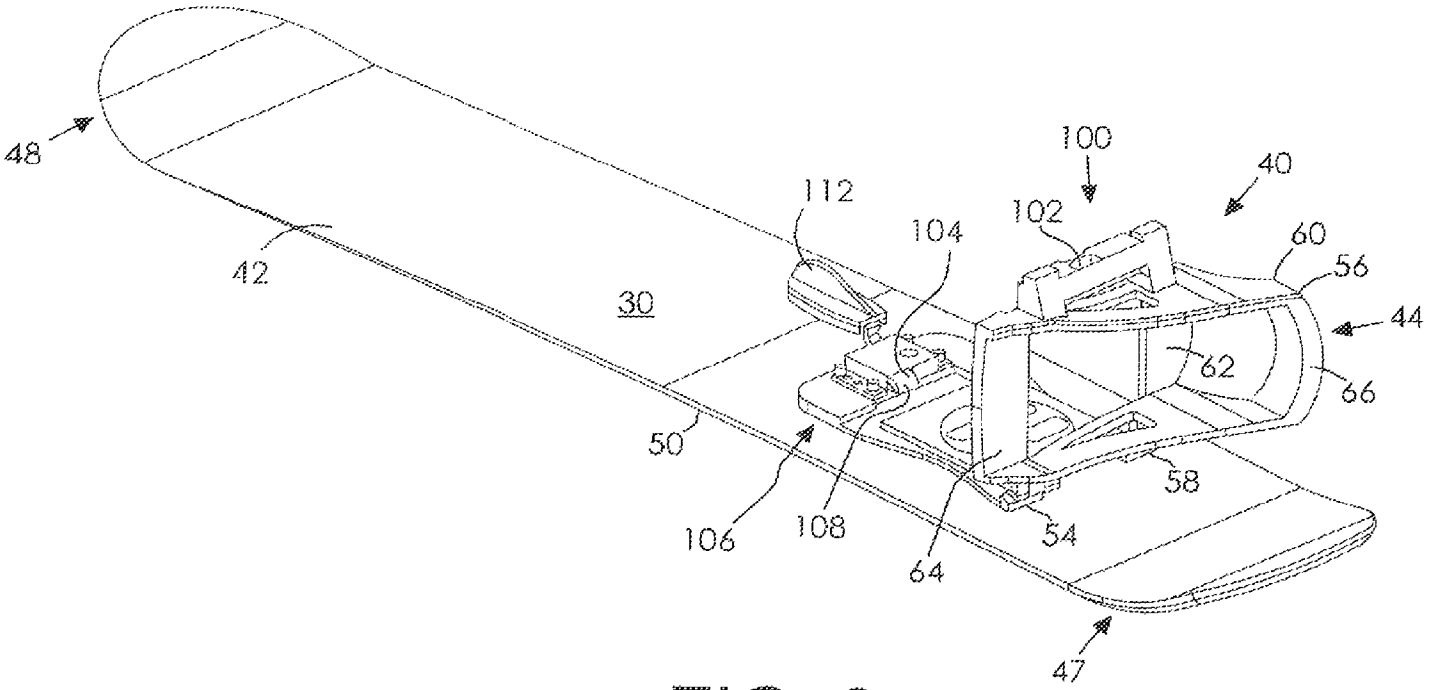
FIG. 3 is an isometric view of a preferred embodiment of the invention showing a binding assembly mounted on a snowboard with its boot retention member in its open position.
Figure 4:
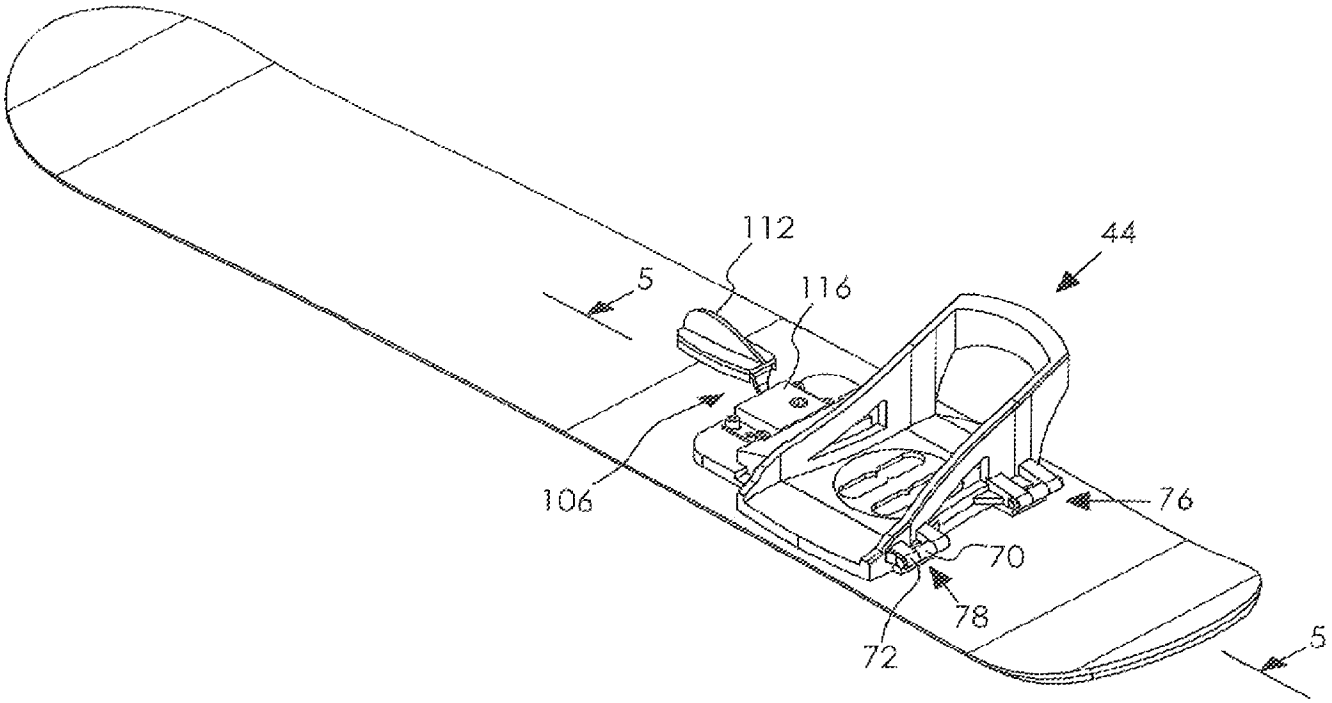
FIG. 4 is an isometric view similar to FIG. 3 but showing the binding assembly boot retention member in its closed position.

The present invention is directed to a method and apparatus which enables a user to suspend his snowboard 30 substantially vertically (FIG. 2) during his upslope travel so as to avoid excessive stress on the user's supporting limb 32. As will be described hereinafter with reference to FIGS. 3-8, a preferred embodiment of the invention comprises a binding assembly 40 mounted to the top surface 42 of snowboard 30. The binding assembly 40 is characterized by a boot retention member 44 supported for selective movement relative to the board 30 between an open position (FIG. 3) and a closed position (FIG. 4). In the open position, the boot retention member 44 orients the user's boot 45 so the plane of the boot's sole 46 is substantially perpendicular to the snowboard top surface 42, thus allowing the board to assume the substantially vertical orientation depicted in FIG. 2. In the closed position, the retention member 44 orients the boot sole so as to be parallel and proximate to the snowboard top surface 42 so as to enable normal snowboard activity.

Attention is now directed to FIGS. 3-8 which illustrate a preferred binding assembly 40 in accordance with the invention mounted on an exemplary snowboard 30 near the board's nose end 47. A rear binding (not shown) is typically mounted closer to the board's tail end. The snowboard 30 defines a top surface 42 extending from a nose end 47 to a tail end 43. The board 30 also defines an under surface 50 for engaging a snow surface. The binding assembly 40 is comprised primarily of a boot retention member 44 hinged to a mounting plate 54 for pivotal movement between an open position (FIG. 3) and a closed position (FIG. 4).

The boot retention member 44 comprises a frame 56 defining a forward side wall 58, a rearward side wall 60, two or more boot support members 62, 64, and a heel support member 66. The frame elements collectively encompass a volume for accommodating a user's snowboard boot 45 with the boot sole 46 bearing against the substantially planar surfaces of support members 62, 64. The boot can be secured in the frame 56 by a variety of well know devices generally referred to as binding and/or safety straps (not shown).

In accordance with a preferred embodiment of the invention, the lower outside edge of forward side wall 58 (closest to the board nose) carries one or more hinge barrels 70 (FIG. 7) configured to align with hinge barrels 72 extending from the forward edge of mounting plate 54. Although any of a variety of hinge structures can be employed in accordance with the invention, an exemplary embodiment preferably utilizes two separate hinge structures 76, 78 (FIG. 7) located proximate to the toe and heel regions of the boot retention member 44. More particularly, each hinge structure 76, 78 is preferably comprised of two mounting plate barrels 72 spaced to receive a retention member barrel 70 therebetween. The barrels of each of the hinge structures 76, 78 are aligned to receive a locking pin 80 which extends through the respective barrel orifices and defines a hinge axis.

Figure 5:
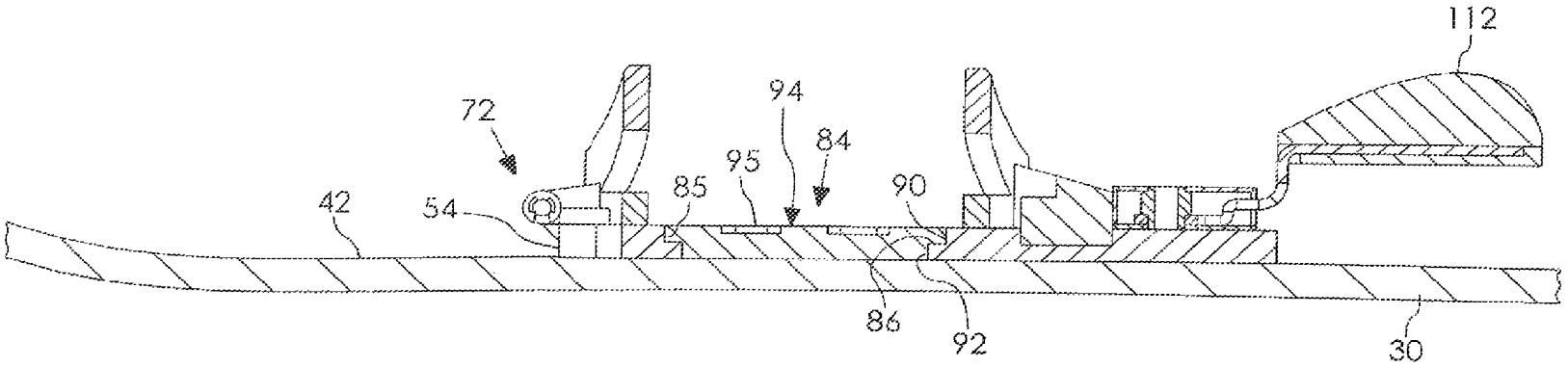
FIG. 5 is a sectional view taken substantially along a plane of FIG. 4.
Figure 6:
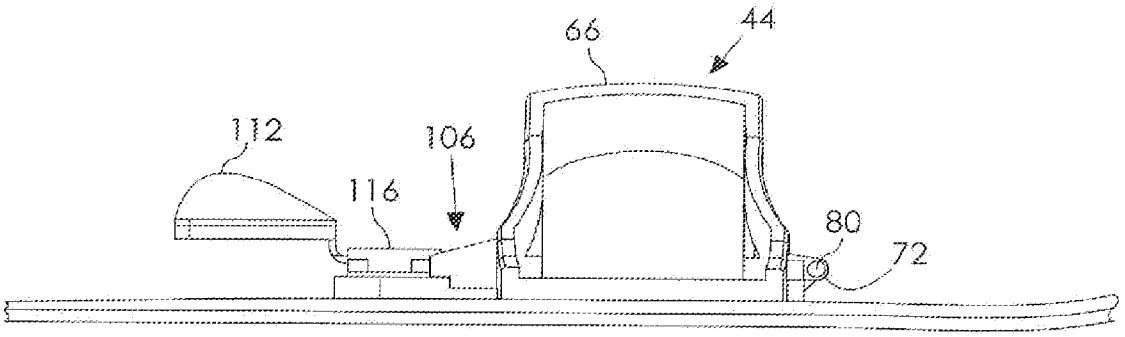
FIG. 6 is a front view of the binding assembly of FIG. 4.
Figure 7:
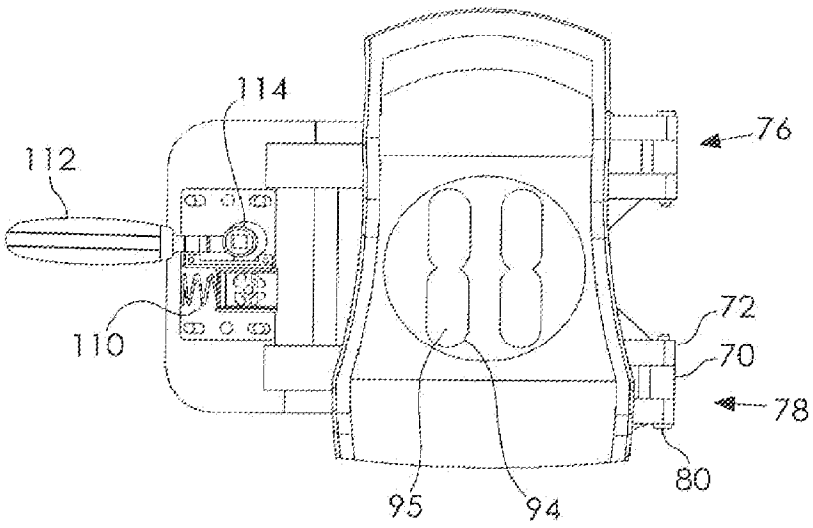
FIG. 7 is top view of the binding assembly of FIG. 4.
Figure 8:
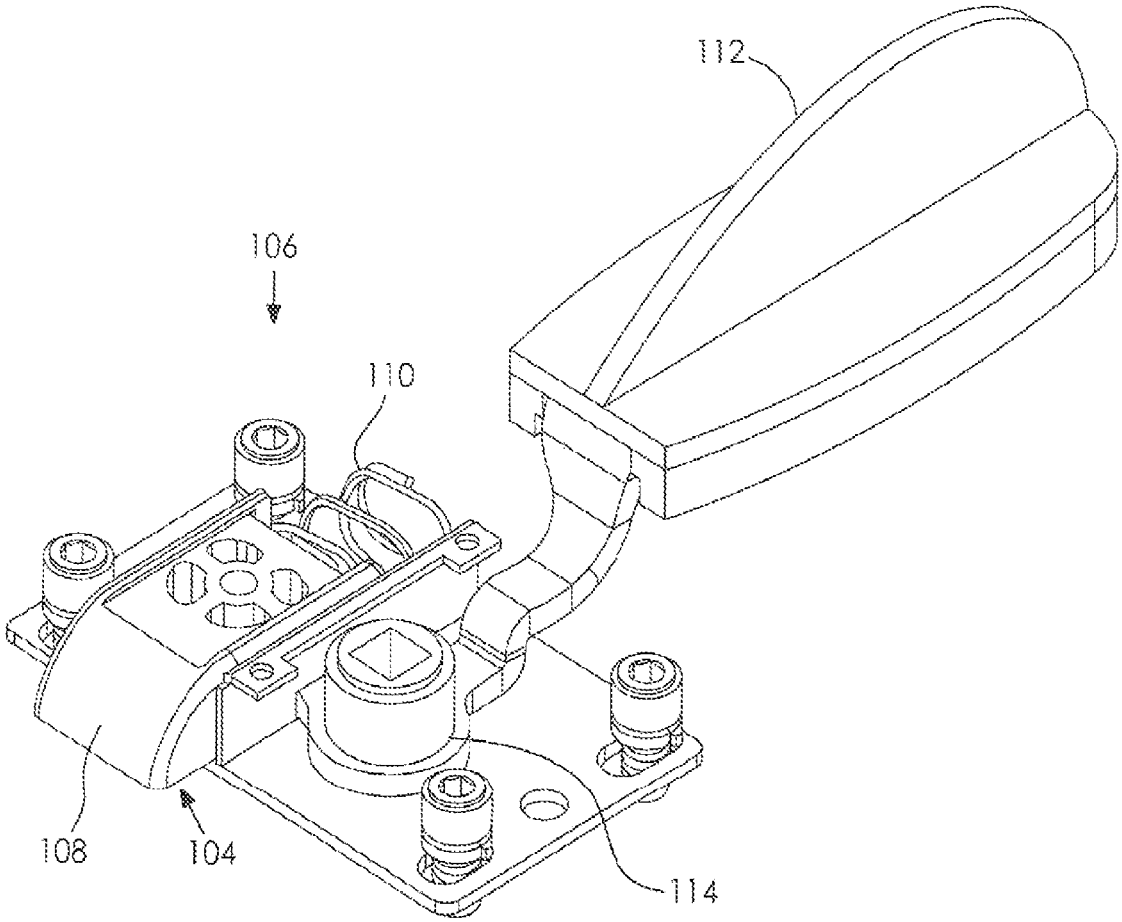
FIG. 8 is an isometric view of an exemplary latch for mechanism for latching the binding assembly in the closed position.

The hinge structures 76, 78 are designed to preferably offer a range of approximately 0 to 125 degrees of rotational freedom around the hinge axis allowing the retention member 52 to pivot between the closed position (FIG. 3) and the open position (FIG. 4), FIG. 5 depicts a preferred arrangement for mounting the aforementioned mounting plate 54 to the board top surface 42. The mounting plate 54 includes a central aperture 84 defined by a peripheral wall 85 including a step offset 86 so as to define an upper wall portion 90 and a lower wall portion 92. A disk plate 94 is attached to the board top surface, by suitable fasteners, e.g. screws (not shown) extending through slots 95. The disk plate 94 extends through the mounting plate aperture 84 so as to bear against the step 86 to affix the mounting plate 54 to the board 30. As is well known in the art, it is typical to allow for rotational adjustment of the mounting plate 54 around the disk plate 94 to achieve the user's preferred stance on the board.

A block 100 extends from the lower rearward side wall 60 of retention member 44 and defines a bay or cavity 102 configured to closely accommodate a latch member 104 when in the closed position. The latch member 104 is mounted in latch mechanism 106 for movement between a forward latched position and a rearward release position. The latch member 104 is preferably provided with an inclined forward surface 108 such that a downward force applied to the surface 108 forces the latch member 104 rearwardly toward the release position. A spring 110 (FIG. 8) bears against the latch member 104 biasing it forward to the latched position and into the bay 102 in, block 100 when the retention member 44 is in the closed position (FIG. 4). The latch mechanism 106 is preferably of a type frequently referred to as a "slam latch" and various configurations are commercially available (e.g., Sierra Pacific Engineering 315LSS-01).

The latch mechanism 106 includes an actuator 112, e.g. a lever, which can be manually operated by a user to move the latch member 104 from the latched position to the release position. More particularly, by manually (via the user's hand or foot) rotating actuator 112 around pivot point 114 (clockwise in FIG. 8), the latch member 104 will be moved rearwardly, against the force offered by spring 110 anchored against a wall of latch cover 116, to withdraw the latch member from the block bay 102. Withdrawal of the latch member 104 from the bay 102 frees the boot retention member 44 to pivot around the hinge axis defined by hinge structures 76, 78 thus concurrently enabling the board 30 to swing to a substantially vertical orientation (FIG. 2) with the board's top surface oriented substantially perpendicular to the plane of the user's boot sole 46 The hinge structures are preferably designed to assure that the board 30 swings open smoothly in controlled fashion, e.g., by proper choice of hinge structure material and/or dimensional tolerances It should be noted that the lever actuator 112 extends rearwardly substantially parallel to the board top surface 42. Thus, it can be readily accessed by the user manually applying a horizontal force to release the latch mechanism 106.

Figure 2:
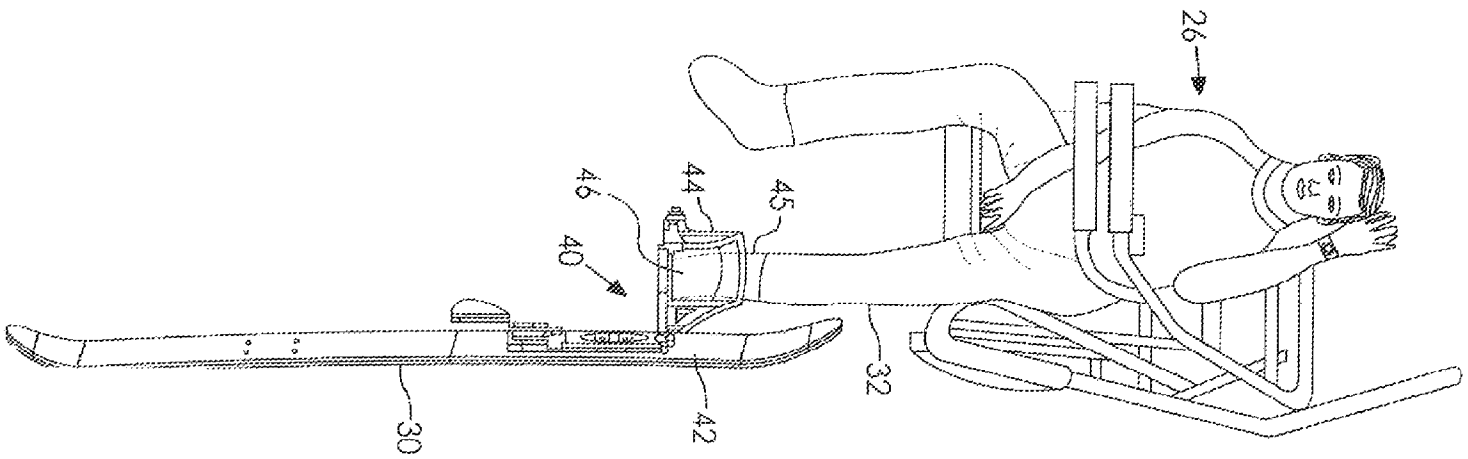
FIG. 2 is a schematic depiction of a snowboard user on a chairlift showing the use of an embodiment of the invention to suspend a snowboard substantially vertically from the users supporting limb.

With reference primarily to FIG. 1, a preferred method of using embodiments of the invention include the following steps:

at time T0: Snowboarder 26 awaiting entry onto lift chair with binding assembly retention member 44 in the closed position. The slam latch 106 secures the retention member in the closed position.

at time T1: After mounting the chair, the user uses his hand or free foot to apply a horizontal force to lever 112 to pivot it about pivot point 114 to thus withdraw the latch member 104 from bay 102 thus allowing the retention member to rotate around the hinge axis, thus swinging the board 30 to the vertical orientation suspended from the users limb (FIG. 2). Thereafter, the user will ride the chair upslope with the board 30 hanging substantially vertically to mitigate stress on the user's supporting limb, until approaching the exit at time T3.

at time T3: The user can place his free foot underneath the snowboard to pull it upward, and initiate the aforedescribed latching operation. As the retention member block 100 bears against the inclined surface 108 of the slam latch mechanism 106, the latch member 104 will slide rearwardly against spring 110 to allow the retention member to fully seat against the mounting plate 54. The spring 110 then automatically returns the latch member into the locking bay 102. The user is then able to exit the lift with ease with full control restored for normal snowboard activity. Significantly, the user also has the option of exiting the lift with the retention member 44 in the open position and relying on the downward force of the user's weight to initiate the latching operation, i.e. block 100 bearing against the inclined surface 108 to slide latch member 104 rearwardly and position bay 102 to receive the latch member moved forward by spring 110.

It should now be apparent that the invention described herein is broadly directed to a method and apparatus for relieving stress and discomfort previously experienced by a typical snowboarder when riding up a chairlift. It should be understood that the particular apparatus described represents a preferred embodiment and it is recognized that modifications and variations are likely to occur to those skilled in the art within the intended scope of the invention, as defined by the appended claims. For example only, the hinge structures 76, 78 and latch mechanism 106 can be implemented in a variety of different ways, all consistent with the teachings of the invention.

What is claimed is:

1. A method of mitigating the body stress experienced by a snowboard user while riding a chairlift, said method comprising:

mounting on the top surface of a snowboard, a boot binding comprising a boot retention member configured for accommodating a user's boot and wherein said retention member is coupled to said snowboard for hinged movement between a closed position orienting the sole of said user's boot substantially parallel to said snowboard top surface and an open position orienting said sole substantially perpendicular to said snowboard top surface, wherein the hinged movement occurs about a fixed axis;

placing said retention member in said closed position for normal snowboard activity, wherein said retention member is fixed in the closed position by a slam latch and a release mechanism, wherein said release mechanism comprises a rotating actuator configured to rotate about a vertical axis, along the plane of said snowboard top surface; and placing said retention member in said open position while the user is on a chairlift by actuating the release mechanism to release the slam latch to allow said board to hang substantially vertically from the user's supporting limb.

2. The method of claim 1 wherein said step of placing said retention member in said closed position includes applying a force to said retention member directed toward said snowboard top surface.

3. The method of claim 1 wherein said step of placing said retention member in said closed position includes latching said retention member.

4. The method of claim 1 wherein said step of placing said retention member in said open position includes user activation of a latch release member.

5. The method of claim 1, wherein the fixed axis is substantially perpendicular to a toe edge of the snowboard.

6. The method of claim 5, wherein the fixed axis is positioned on an edge of the mounting structure towards a nose end of the snowboard.

7. A binding assembly for coupling a user's boot to the top surface of a snowboard, said assembly comprising:

a boot retention member for engaging the sole of a user's boot;

a mounting structure coupling said boot retention member to said snowboard top surface so as to allow said retention member to pivot between a closed position orienting said boot sole substantially parallel to said snowboard top surface and an open position orienting said boot sole substantially perpendicular to said snowboard top surface, wherein the pivot occurs about a fixed axis;

a slam latch mechanism operable to latch said retention member in said closed position, wherein said retention member is fixed in the closed position by said slam latch; and a user operable release mechanism for releasing said latch mechanism to allow said boot retention member to pivot to said open position, wherein said release mechanism comprises a rotating actuator configured to rotate about a vertical axis, along the plane of said snowboard top surface.

8. The binding assembly of claim 7 wherein said mounting structure includes a hinge.

9. The binding assembly of claim 7 wherein said rotating actuator comprises a lever mounted proximate to said snowboard top surface accessible to said user.

10. The binding assembly of claim 7, wherein the fixed axis is substantially perpendicular to a toe edge of the snowboard.

11. The binding assembly of claim 10, wherein the fixed axis is positioned on an edge of the mounting structure towards a nose end of the snowboard.

12. In combination with a snowboard having a length, a width, and a top surface, a binding assembly comprising:

a boot retention member including a boot sole support member defining a substantially planar sole support surface;

a mounting structure attaching said boot retention member to said snowboard top surface and wherein said mounting structure includes a hinge allowing the plane of said sole support surface to pivot between a first position oriented substantially perpendicular to said snowboard top surface and a second position substantially parallel to said snowboard top surface, wherein the pivot occurs about a fixed axis;

a slam latch mechanism responsive to movement of said sole support surface from said first position to said second position for latching said sole support member in said second position, wherein said retention member is fixed in the second position by the slam latch; and a user operable rotating actuator for unlatching said sole support member to allow said snowboard and sole support surface to move to said first position, wherein said rotating actuator is configured to rotate about a vertical axis, along the plane of said snowboard top surface.

13. The combination of claim 9 wherein said slam latch mechanism includes a latch member mounted for movement between a latched position and an unlatched position; and a spring for biasing said latch member to said latched position.

14. The combination of claim 13 wherein said boot retention member includes a bay for accommodating said slam latch member in said latched position; and wherein said actuator is operable to remove said slam latch member from said bay.

15. The binding assembly of claim 12, wherein the fixed axis is substantially perpendicular to a toe edge of the snowboard.

16. The binding assembly of claim 15, wherein the fixed axis is positioned on an edge of the mounting structure towards a nose end of the snowboard.

* * * * *